US011192735B2

(12) United States Patent
Otsuka

(10) Patent No.: US 11,192,735 B2
(45) Date of Patent: Dec. 7, 2021

(54) IMAGE FORMING APPARATUS AND RECORDING MATERIAL MOUNT DEVICE

(71) Applicant: FUJIFILM Business Innovation Corp., Tokyo (JP)

(72) Inventor: Yuji Otsuka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 80 days.

(21) Appl. No.: 16/253,225

(22) Filed: Jan. 22, 2019

(65) Prior Publication Data

US 2020/0055681 A1 Feb. 20, 2020

(30) Foreign Application Priority Data

Aug. 16, 2018 (JP) ..... JP2018-153282

(51) Int. Cl.
*B65H 3/66* (2006.01)
*B65H 1/26* (2006.01)
*B65H 1/04* (2006.01)

(52) U.S. Cl.
CPC ..... *B65H 1/266* (2013.01); *B65H 1/04* (2013.01); *B65H 3/66* (2013.01)

(58) Field of Classification Search
CPC ..... B65H 3/68; B65H 2405/1122; B65H 2405/114; B65H 2405/1144; B65H 2405/121; B65H 2405/1414
See application file for complete search history.

(56) References Cited

U.S. PATENT DOCUMENTS 5,632,477 A * 5/1997 Morinaga ..... B65H 1/08 271/127
8,087,664 B2 * 1/2012 Imai ..... B65H 1/266 271/171
9,969,577 B2 5/2018 Eguchi
2016/0062295 A1 * 3/2016 Iwama ..... B65H 1/04 271/241
2016/0280482 A1 * 9/2016 Takai ..... G03G 15/6502

FOREIGN PATENT DOCUMENTS

JP 2017154864 9/2017

* cited by examiner

*Primary Examiner* — Howard J Sanders
(74) *Attorney, Agent, or Firm* — JCIPRNET

(57) ABSTRACT

An image forming apparatus includes an apparatus body that forms an image on a recording material; a drawn-out unit that is provided so as to be drawable from the apparatus body and has a mount region on which the recording material is mounted; and a guide unit that is provided on the drawn-out unit and guides the recording material to a position where the recording material is to be mounted on the mount region. The guide unit has a guide surface that guides an end of the recording material, a hook part that is hooked onto the drawn-out unit and determines a position relative to the drawn-out unit, and a release part that releases the hook part from the drawn-out unit by being operated by a user from a guide surface side.

15 Claims, 12 Drawing Sheets

IMAGE FORMING APPARATUS AND RECORDING MATERIAL MOUNT DEVICE

CROSS-REFERENCE TO RELATED APPLICATIONS

This application is based on and claims priority under 35 USC 119 from Japanese Patent Application No. 2018-153282 filed Aug. 16, 2018.

BACKGROUND

(i) Technical Field

The present disclosure relates to an image forming apparatus and a recording material mount device.

(ii) Related Art

Japanese Unexamined Patent Application Publication No. 2017-154864 discloses a paper feed tray that includes a pair of side fences that make contact with front-end-side side edges of a stacked sheet of paper so as to regulate a position of the sheet of paper in a width direction and a pair of second regulating members that make contact with rear-side side edges of the sheet of paper so as to regulate a position of the sheet of paper in the width direction. The side fences are provided so as to be movable in the width direction in accordance with a width of the stacked sheet of paper, and the second regulating members are detachably provided and are attachable at plural attachment positions.

SUMMARY

A drawn-out unit that is drawn out from an apparatus body and on which a recording material is mounted is sometimes provided with a guide unit that guides the recording material to a position where the recording material is to be mounted. For example, in a case where a size of a mounted recording material is switched, a user needs to perform an operation of changing a position of the guide unit. In a case where the user cannot operate the guide unit from an inside of the drawn-out unit, it is necessary to provide a large space for the operation of changing the position of the guide unit.

Aspects of non-limiting embodiments of the present disclosure relate to reducing a space for an operation of changing a position of a guide unit as compared with a case where a user cannot operate the guide unit from an inside of a drawn-out unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an apparatus body that forms an image on a recording material; a drawn-out unit that is provided so as to be drawable from the apparatus body and has a mount region on which the recording material is mounted; and a guide unit that is provided on the drawn-out unit and guides the recording material to a position where the recording material is to be mounted on the mount region. The guide unit has a guide surface that guides an end of the recording material, a hook part that is hooked onto the drawn-out unit and determines a position relative to the drawn-out unit, and a release part that releases the hook part from the drawn-out unit by being operated by a user from a guide surface side.

DETAILED DESCRIPTION

An exemplary embodiment of the present disclosure is described below with reference to the attached drawings.

Image Forming Apparatus 1

Figure 1:
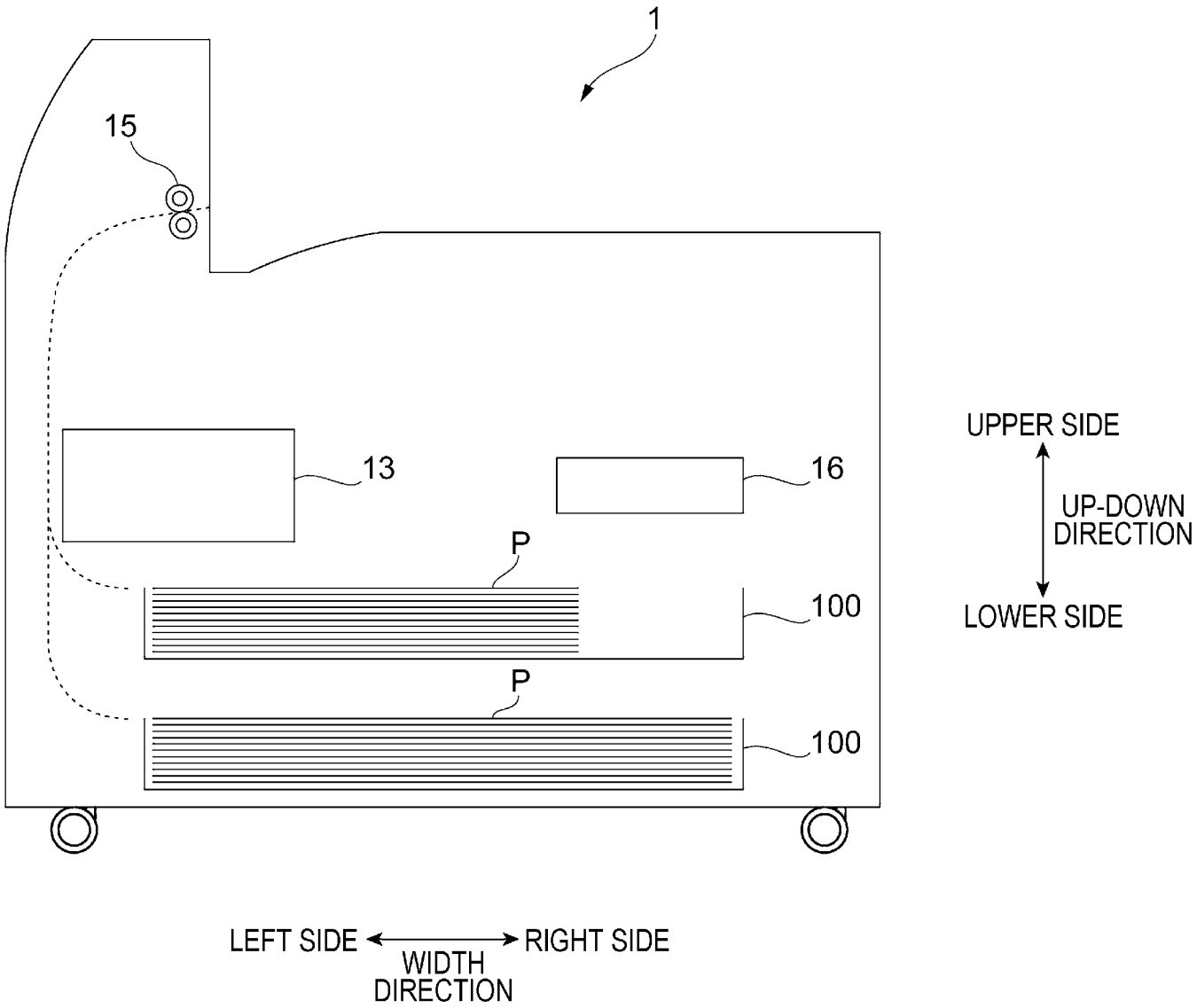
FIG. 1 illustrates a configuration of an image forming apparatus to which the present exemplary embodiment is applied.

FIG. 1 illustrates a configuration of an image forming apparatus 1 to which the present exemplary embodiment is applied.

First, a configuration of the image forming apparatus 1 to which the present exemplary embodiment is applied is described with reference to FIG. 1.

The image forming apparatus 1 forms an image on a recording material (sheet) such as a sheet of paper P. The image forming apparatus 1 illustrated in FIG. 1 includes a paper storage unit(s) 100 in which sheets of paper P are stored, an image forming unit 13 that forms an image on a sheet of paper P, an ejection roller 15 that ejects the sheet of paper P on which an image has been formed, a body controller 16 that controls operation of the image forming apparatus 1, and a housing 20 in which members such as the paper storage unit 100 and the image forming unit 13 are provided. The paper storage unit 100 is an example of a drawn-out unit and a recording material mount device. The housing 20 is an example of an apparatus body.

In the following description, an up-down direction (vertical direction) of the image forming apparatus 1 illustrated in FIG. 1 is sometimes referred simply as an "up-down direction". Furthermore, an upper side in the up-down direction in FIG. 1 and a lower side in the up-down direction in FIG. 1 are sometimes referred simply as an "upper side" and a "lower side", respectively. Furthermore, a left-right direction of the paper on which the image forming apparatus 1 of FIG. 1 is drawn is sometimes referred simply as a "width direction". Furthermore, a right side and a left side of the paper on which FIG. 1 is drawn are sometimes referred simply as a "right side" and a "left side", respectively. Furthermore, a depth direction of the paper on which the image forming apparatus 1 of FIG. 1 is drawn is sometimes referred simply as a "depth direction". Furthermore, a near side and a far side of the paper on which FIG. 1 is drawn are sometimes referred simply as a "near side" and a "far side", respectively.

The paper storage units 100 store therein sheets of paper P of different sizes and kinds, respectively. In the example illustrated in FIG. 1, plural paper storage units 100 are provided. Each of the paper storage units 100 can be drawn out toward the near side in the depth direction. Each of the paper storage units 100 is replenished with sheets of paper P in a state where the paper storage unit 100 has been drawn out, for example, by a user.

The image forming unit 13 forms an image on a sheet of paper P transported from the paper storage unit 100. The image forming unit 13 in the example illustrated in FIG. 1 forms an image on a sheet of paper P according to an electrophotographic system for forming an image by transferring toner attached on a photoconductor onto the sheet of paper P. An image formation system employed in the image forming unit 13 is not limited in particular, and the image forming unit 13 may form an image, for example, according to an inkjet system for forming an image by ejecting ink onto the sheet of paper P.

The ejection roller 15 ejects a sheet of paper P on which an image has been formed by the image forming unit 13. The ejection roller 15 in the example illustrated in FIG. 1 is made up of a pair of rollers, and the sheet of paper P is ejected from the image forming apparatus 1 as a result of rotation of the pair of rollers.

The body controller 16 controls operation of each constituent member provided in the image forming apparatus 1.

The housing 20 accommodates members such as the paper storage unit 100, the image forming unit 13, the ejection roller 15, and the body controller 16. The paper storage unit 100 accommodated in the housing 20 is supported by the housing 20 so that the paper storage unit 100 can be drawn out from the housing 20 and pushed into the housing 20 (see arrows A1 and A2 in FIG. 2 that will be described later).

Operation of the image forming apparatus 1 is described below. First, sheets of paper P are fed from the paper storage unit 100 one by one upon receipt of an instruction signal from the body controller 16. After an image is formed on a sheet of paper P by the image forming unit 13, the sheet of paper P on which the image has been formed is ejected from the ejection roller 15.

Paper Storage Unit 100

Figure 2:
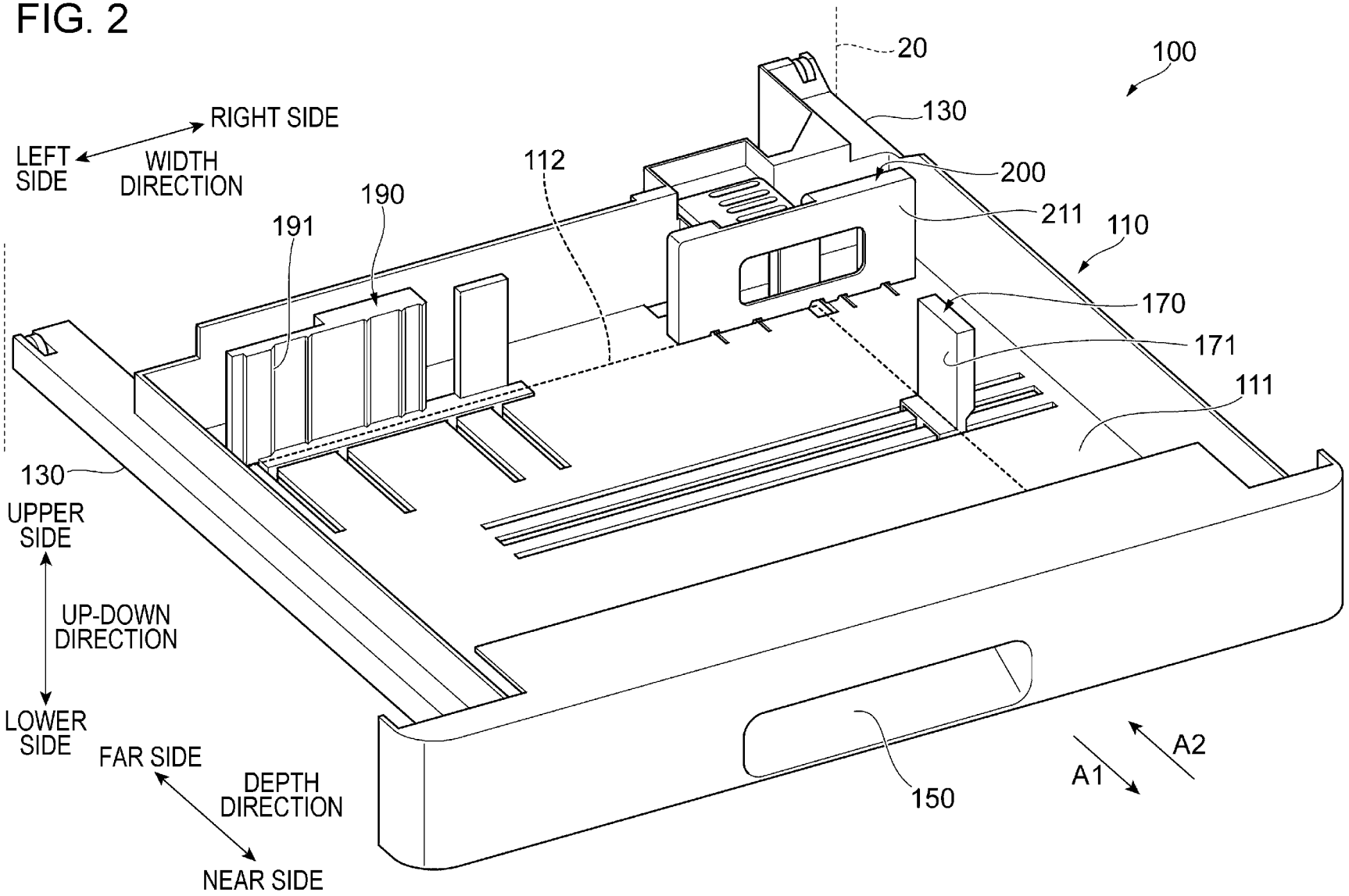
FIG. 2 illustrates a configuration of a paper storage unit.

FIG. 2 illustrates a configuration of the paper storage unit 100.

Next, the configuration of the paper storage unit 100 is described with reference to FIG. 2.

A sheet of paper P stored in the paper storage unit 100 illustrated in FIG. 2 is transported from the right side to the left side in the width direction. Hereinafter, a transport direction in which a sheet of paper P is transported from the right side to the left side in the width direction is sometimes referred to as a "transport direction", a front end of the sheet of paper P in the transport direction is sometimes referred simply as a "front end", and a rear end of the sheet of paper P in the transport direction is sometimes referred simply as a "rear end".

The paper storage unit 100 is drawn out from the housing 20 toward the near side in the depth direction (see arrow A1). The paper storage unit 100 that has been drawn out from the housing 20 is inserted into the housing 20 by pushing the paper storage unit 100 toward the far side in the depth direction (see arrow A2). Only a part of the paper storage unit 100 may be drawn out from the housing 20 without drawing the whole paper storage unit 100 out from the housing 20 while a remaining part of the paper storage unit 100 is held by the housing 20. A direction (see arrow A1) in which the paper storage unit 100 is drawn out toward the near side in the depth direction is an example of a draw out direction.

The paper storage unit 100 has a storage body 110 in which a sheet of paper P is stored, a guide 130 supported by the housing 20, a handle 150 held by a user when the user draws out the storage body 110, a slide restraining member 170 that keeps in place a rear end of the sheet of paper P stored in the storage body 110, and a front-side restraining member 190 and a rear-side restraining member 200 that keep in place a side surface of the sheet of paper P along the transport direction. The rear-side restraining member 200 is an example of a guide unit.

The storage body 110 is a box-shaped member opened on an upper side. The storage body 110 has a bottom part 111 that supports the sheet of paper P. At least part of the bottom part 111 serves as a mount region 112 on which the sheet of paper P is mounted. The mount region 112 is a region surrounded by the slide restraining member 170, the front-side restraining member 190, and the rear-side restraining member 200. More specifically, positions of a left-side end and a near-side end of the mount region 112 are fixed, a position of a right-side end of the mount region 112 is defined by the slide restraining member 170, and a far-side end of the mount region 112 is defined by the front-side restraining member 190 and the rear-side restraining member 200.

The guide 130 is a part that is provided on both ends of the storage body 110 in the width direction and extends in the depth direction. Each guide 130 moves along rails (not illustrated) that are provided along the depth direction in the housing 20. More specifically, each guide 130 slides in the depth direction while being sandwiched between the rails in the up-down direction.

The handle 150 is provided on a near-side side surface of the paper storage unit 100. More specifically, the handle 150 is provided at a position that allows a user present on the near side of the image forming apparatus 1 to operate the handle 150.

The slide restraining member 170 slides in the width direction on the bottom part 111 of the storage body 110. The slide restraining member 170 is provided along a right side of the mount region 112, i.e., a rear end of the sheet of paper P. The slide restraining member 170 has an abutting surface 171 that abuts on the rear end of the sheet of paper P. A position of the slide restraining member 170 in the width direction is adjusted by a user in accordance with a size of the sheet of paper P mounted on the storage body 110.

The front-side restraining member 190 slides in the depth direction on the bottom part 111 of the storage body 110. The front-side restraining member 190 is provided on a far side of the mount region 112 and a front-end side of the sheet of paper P. This front-side restraining member 190 has plural abutting ribs 191 that abut on a far-side side surface of the sheet of paper P. Each of the abutting ribs 191 extends in the up-down direction. A position of the front-side restraining member 190 in the depth direction is adjusted by a user in accordance with a size of the sheet of paper P mounted on the storage body 110.

The rear-side restraining member 200 is provided so as to be displaceable in the depth direction on the bottom part 111 of the storage body 110. The rear-side restraining member 200 is attachable to and detachable from the storage body 110. The rear-side restraining member 200 is disposed at any of plural positions that are aligned in the depth direction on the bottom part 111 of the storage body 110. Details of this will be described later. The rear-side restraining member 200 is provided on a far side of the mount region 112 and a rear-end side of the sheet of paper P. This rear-side restraining member 200 has a guide surface 211 that abuts on a far-side side surface of the sheet of paper P. A position of the rear-side restraining member 200 in the depth direction is adjusted by a user in accordance with a size of the sheet of paper P mounted on the storage body 110. The rear-side restraining member 200 is provided at a position that allows a user to view the rear-side restraining member 200 without drawing the whole storage body 110 out from the housing 20.

In the example illustrated in FIG. 2, the front-side restraining member 190 and the rear-side restraining member 200 are provided on a far side of the mount region 112 but is not provided on a near side of the mount region 112. This is because a higher priority is given to a position that contributes more to restraint of movement of the sheet of paper P in an operation of pushing the storage body 110 into the housing 20. That is, the front-side restraining member 190 and the rear-side restraining member 200 are disposed so as to restrain the sheet of paper P that moves together with the storage body 110 from moving toward the far side when the storage body 110 is pushed into the housing 20.

An inside of the storage body 110 is a space in the storage body 110 that is exposed in a state where the storage body 110 has been drawn out from the housing 20. The inside of the storage body 110 may be regarded as a space in which the sheet of paper P is stacked in the storage body 110. From another perspective, the inside of the storage body 110 is regarded as a space on an upper side of the mount region 112.

Structure Around Rear-Side Restraining Member 200

Figure 3:
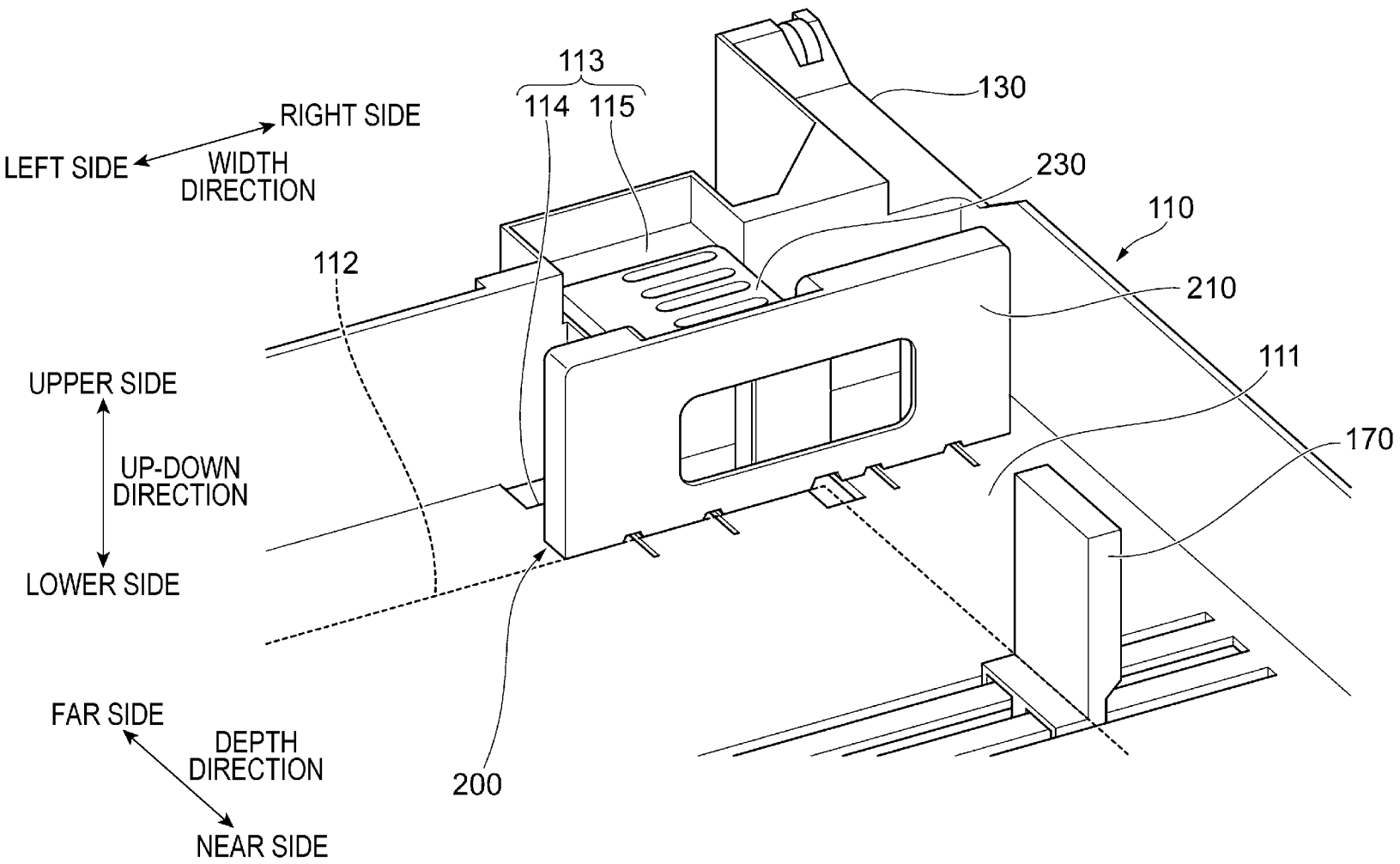
FIG. 3 illustrates a structure around a rear-side restraining member in the paper storage unit.

FIG. 3 illustrates a structure around the rear-side restraining member 200 in the paper storage unit 100.

Next, a structure around the rear-side restraining member 200 in the paper storage unit 100 is described with reference to FIG. 3.

As illustrated in FIG. 3, the paper storage unit 100 has, on a far side of the mount region 112, a position determining part 113 that determines a position of the rear-side restraining member 200. The position determining part 113 has a lower position determining part 114 that is provided on the bottom part 111 and an upper position determining part 115 that is provided so as to protrude upward from the bottom part 111. The lower position determining part 114 and the upper position determining part 115 each determine a position of the rear-side restraining member 200 at any of plural positions in the depth direction. Details of this will be described later.

Position Determining Part 113

Figure 4:
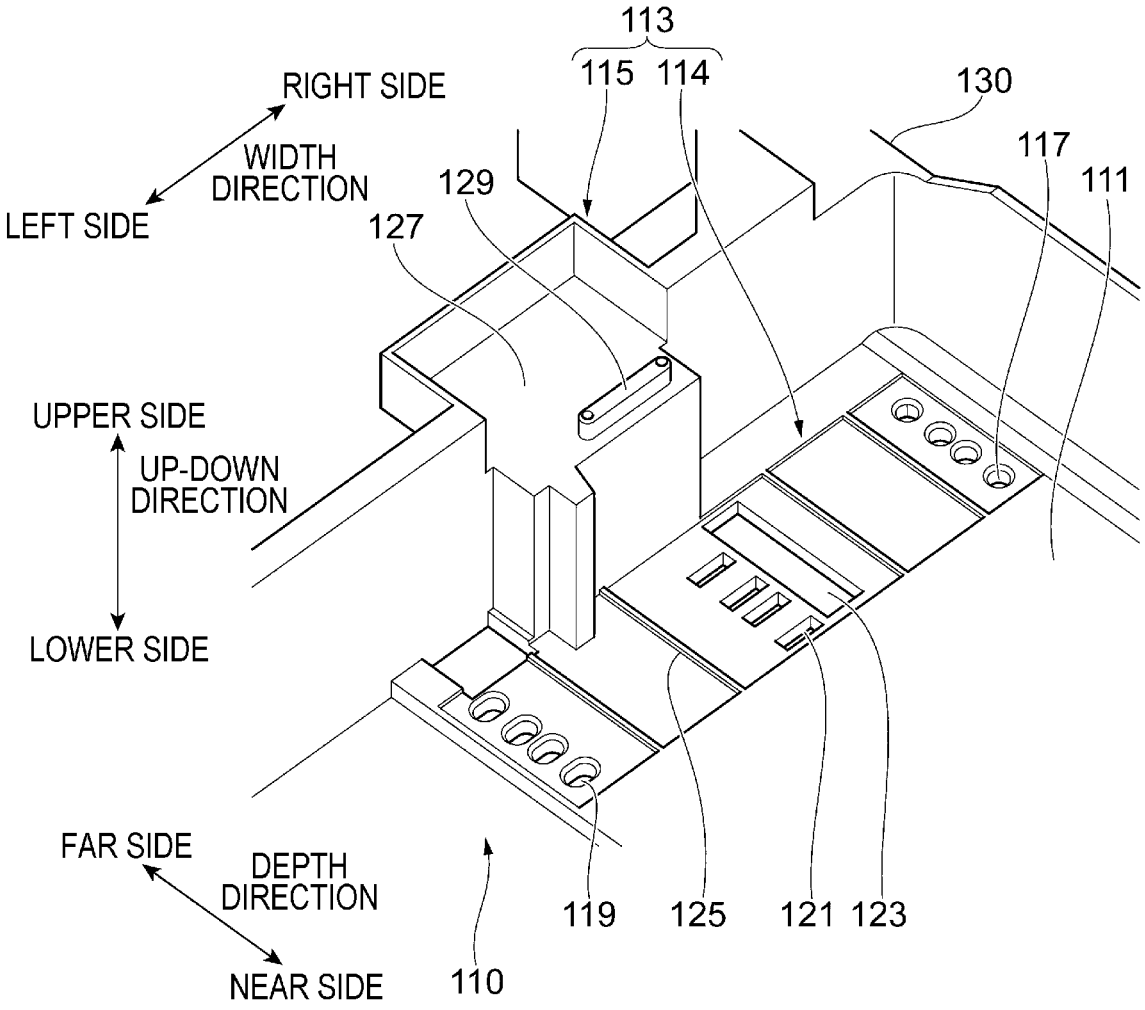
FIG. 4 illustrates a detailed configuration of a position determining part.

FIG. 4 illustrates a detailed configuration of the position determining part 113.

Next, a detailed configuration of the position determining part 113 is described with reference to FIG. 4. The following first describes the lower position determining part 114 and then describes the upper position determining part 115.

As illustrated in FIG. 4, the lower position determining part 114 illustrated in FIG. 4 is a flat region recessed downward from the bottom part 111. The lower position determining part 114 in the example illustrated in FIG. 4 has a substantially rectangular shape when viewed from above and is provided so that a longitudinal direction thereof matches the width direction. The lower position determining part 114 has a first position determining part 117, a second position determining part 119, a third position determining part 121, and an opening for lever 123 into which some of elements of the rear-side restraining member 200 are to be inserted, respectively. Furthermore, the lower position determining part 114 has a support rib 125 that supports the sheet of paper P.

The first position determining part 117 is made up of plural holes aligned in the depth direction. The first position determining part 117 in the example illustrated in FIG. 4 is made up of four substantially circular through-holes that are aligned in the depth direction.

The second position determining part 119 is made up of plural long holes that are aligned in the depth direction. The second position determining part 119 in the example illustrated in FIG. 4 is made up of four elliptical through-holes whose longitudinal direction matches the width direction and that are aligned in the depth direction. The second position determining part 119 has a dimension that allows a part (a second position determining protrusion 219 that will be described later) of the rear-side restraining member 200 inserted into the second position determining part 119 to move in the width direction. This reduces occurrence of a situation where the rear-side restraining member 200 cannot be attached, for example, even in a case where the rear-side restraining member 200 has a dimensional production error.

The third position determining part 121 is made up of plural long holes aligned in the depth direction. The third position determining part 121 in the example illustrated in FIG. 4 is made up of four rectangular through-holes whose longitudinal direction matches the width direction and that are aligned in the depth direction. The third position determining part 121 has a dimension that allows a part (a third position determining protrusion 221 that will be described later) of the rear-side restraining member 200 inserted into the third position determining part 121 to move in the width direction.

The opening for lever 123 is a substantially rectangular through-hole. The opening for lever 123 in the example illustrated in FIG. 4 is provided so that a longitudinal direction thereof matches the depth direction.

The support rib 125 is a projection provided on the lower position determining part 114 and extends continuously in the depth direction. In the example illustrated in FIG. 4, plural support ribs 125 are provided side by side in the width direction.

In the example illustrated in FIG. 4, the first position determining part 117 and the second position determining part 119 are disposed on both ends of the lower position determining part 114 in the width direction, and the third position determining part 121 is disposed between the first position determining part 117 and the second position determining part 119. The opening for lever 123 is disposed between the first position determining part 117 and the third position determining part 121.

The through-holes that constitute the first position determining part 117, the second position determining part 119, and the third position determining part 121 are disposed at the same positions in the depth direction. A position of the rear-side restraining member 200 is determined by fixing the rear-side restraining member 200 to a combination of through-holes provided at the same position in the depth direction among the through-holes that constitute the first position determining part 117, the second position determining part 119, and the third position determining part 121.

Next, the upper position determining part 115 is described. The upper position determining part 115 has a support surface 127 that is a surface parallel with the bottom part 111 and a position determining protrusion 129 provided on the support surface 127. The position determining protrusion 129 is a projection that protrudes upward from the support surface 127 and extends continuously in the width direction. More specifically, the position determining protrusion 129 is a projection that has a substantially elliptical shape when viewed from above. A position of the rear-side restraining member 200 is determined by fixing the rear-side restraining member 200 to the position determining protrusion 129.

Rear-Side Restraining Member 200

Figure 5A:
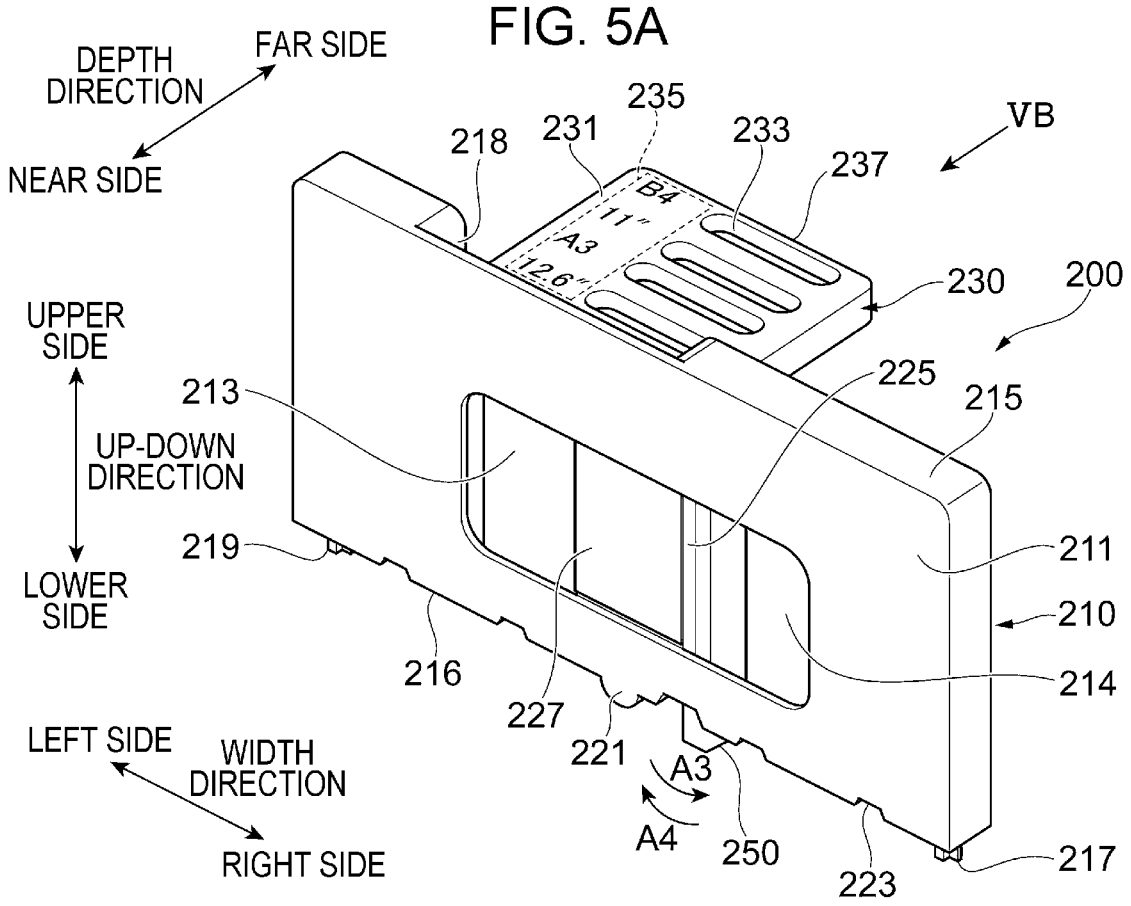
FIGS. 5A and 5B illustrate a detailed configuration of the rear-side restraining member.
Figure 5B:
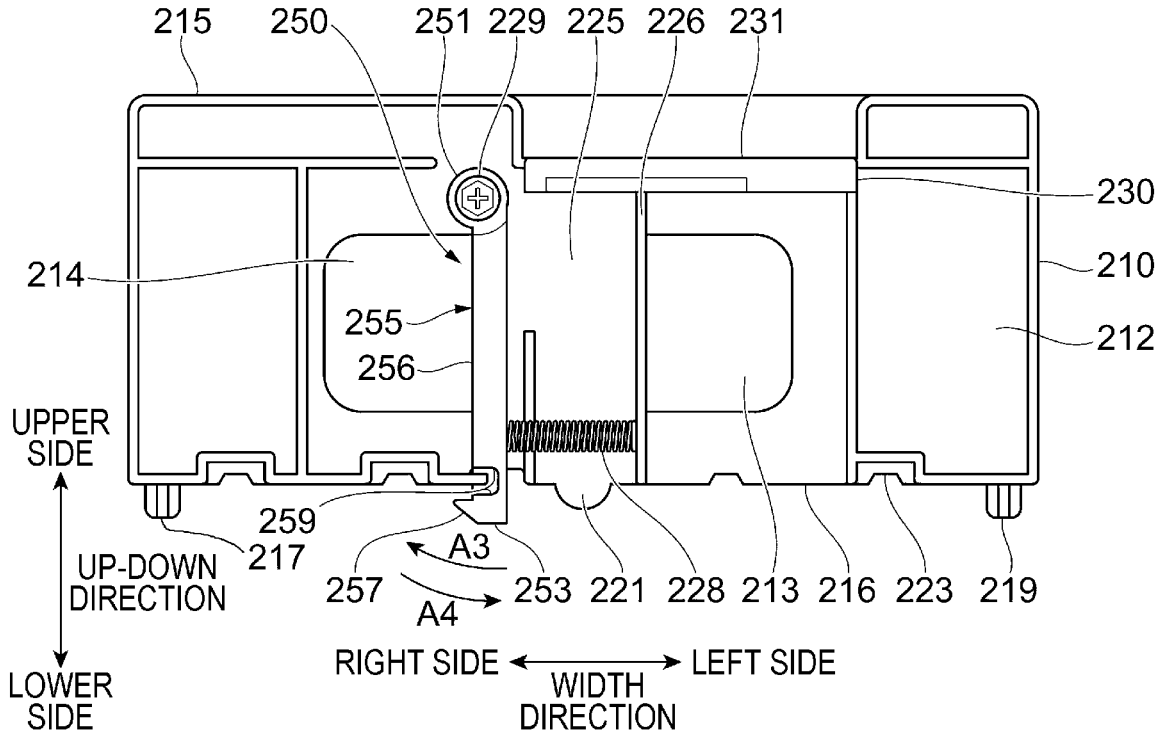

FIGS. 5A and 5B illustrate a detailed configuration of the rear-side restraining member 200. Specifically, FIG. 5A is a perspective view of the rear-side restraining member 200, and FIG. 5B is a view viewed from arrow Vb in FIG. 5A, i.e., a view illustrating the rear-side restraining member 200 viewed from a far side toward a near side in the depth direction.

Next, a detailed configuration of the rear-side restraining member 200 is described with reference to FIGS. 5A and 5B. As illustrated in FIGS. 5A and 5B, the rear-side restraining member 200 has a guide body 210 that is a plate member, a guide position determining part 230 that is a plate member provided so as to be bent from the guide body 210, and an operation lever 250 operated by a user.

The guide body 210 is described below. The guide body 210 has a guide surface 211 that faces the near side in the depth direction and guides the sheet of paper P and a first opening 213 and a second opening 214 that are through-openings provided in the guide surface 211. Furthermore, the guide body 210 has a guide upper end 215 that is an upper end of the guide body 210 and a guide lower end 216 that is a lower end of the guide body 210. The first opening 213 and the second opening 214 are examples of a cutout. The guide lower end 216 is an example of a lower surface of a guide unit. The guide surface 211 is an example of a guide surface.

The guide body 210 has a first position determining protrusion 217, a second position determining protrusion 219, and a third position determining protrusion 221 that are protrusions protruding downward from the guide lower end 216, and a support rib receiver 223 that is a recess recessed upward from the guide lower end 216. Furthermore, the guide body 210 has an attachment part 225 that is a surface recessed toward the depth side relative to the guide surface 211 and a spring rib 226 that protrudes toward the far side from a rear surface 212 (see FIG. 5B) opposite to the guide surface 211 of the guide body 210.

Furthermore, the guide body 210 has a seal member 227 attached to the attachment part 225, a coil spring 228 that gives elasticity to the operation lever 250, and a support shaft 229 that is constituted by a bolt or the like and rotatably supports an end (a first end 251 that will be described later) of the operation lever 250. The coil spring 228 is an example of an energizing part. The seal member 227 is an example of a sheet member.

The first opening 213 and the second opening 214 are provided away from each other in the width direction in the guide surface 211. In the example illustrated in FIGS. 5A and 5B, a part sandwiched between the first opening 213 and the second opening 214 is the attachment part 225. The first opening 213 and the second opening 214 each have a substantially rectangular shape and have a dimension that allows a user's finger (e.g., user's first finger and second finger) to be inserted thereinto. Since an outer periphery of the first opening 213 and an outer periphery of the second opening 214 are surrounded by the guide surface 211, for example, since an upper side of the first opening 213 and an upper side of the second opening 214 are not opened, detachment of the user's fingers from the first opening 213 and the second opening 214 becomes less likely.

The first position determining protrusion 217, the second position determining protrusion 219, and the third position determining protrusion 221 are provided at positions corresponding to the first position determining part 117, the second position determining part 119, and the third position determining part 121 of the lower position determining part 114, respectively. The support rib receiver 223 is provided at a position corresponding to the support rib 125 of the position determining part 113. The first position determining protrusion 217, the second position determining protrusion 219, and the third position determining protrusion 221 are inserted into the first position determining part 117, the second position determining part 119, and the third position determining part 121, respectively, and thereby a position of the guide body 210 is determined by the lower position determining part 114. In this state where the position of the guide body 210 has been determined, the support rib 125 is disposed in the support rib receiver 223.

The seal member 227 is constituted, for example, by a resin film, and an image such as an image showing a method for operating the rear-side restraining member 200 is formed on a surface of the seal member 227. The seal member 227 is disposed on a far side relative to the guide surface 211 so as to be away from the sheet of paper P mounted on the mount region 112. This keeps the sheet of paper P and the seal member 227 from rubbing against each other.

The coil spring 228 is compressed between the operation lever 250 and the spring rib 226 and thereby gives power for causing the operation lever 250 to rotate in one direction (see arrow A3 in FIGS. 5A and 5B) about the support shaft 229. More specifically, the coil spring 228 energizes the operation lever 250 toward the second opening 214.

Next, the guide position determining part 230 is described. The guide position determining part 230 has a position determining surface 231 that faces upward in the up-down direction and is orthogonal to the guide surface 211, position determining holes 233 that are through-holes formed in the position determining surface 231, a position guide marker 235 formed beside the position determining holes 233, and a far-side end 237 that is a far-side end of the guide position determining part 230. The guide position determining part 230 is an example of a position indicator body. The position determining surface 231 is an example of an upper surface. The position guide marker 235 is an example of an indicator.

The position determining surface 231 of the guide position determining part 230 is located on a far side relative to the guide body 210 and on a lower side relative to the guide upper end 215 (details will be described later). The guide body 210 has, in a central part in the width direction of the guide upper end 215 on a far side, a cutout 218 that has a substantially rectangular shape when viewed from above. The guide position determining part 230 is provided at a position corresponding to the cutout 218 in the width direction.

The position determining holes 233 are plural long holes aligned in the depth direction. Each of the position determining holes 233 in the example illustrated in FIGS. 5A and 5B is a through-hole that has an elliptical shape whose longitudinal direction matches the width direction. The position determining protrusion 129 is inserted into any of the long holes that constitute the position determining holes 233, and thereby a position of the guide position determining part 230 is determined.

The position guide marker 235 has, at each of positions corresponding to the long holes that constitute the position determining holes 233, a character string or the like that indicates a position where the rear-side restraining member 200 is installed. The position guide marker 235 illustrated in FIG. 5A indicates sizes of sheets of paper P to be mounted on the mount region 112 when the position determining protrusion 129 is inserted into the long holes.

Next, the operation lever 250 is described. The operation lever 250 has a lever body 255 having a substantially rectangular parallelepiped shape. The lever body 255 is provided so that a longitudinal direction thereof matches the up-down direction and has a first end 251 located on an upper side and a second end 253 located on a lower side. Furthermore, the operation lever 250 has a tapered part 257 provided at the second end 253 of the lever body 255 and a cutout 259 provided on a first end 251 side relative to the tapered part 257. The operation lever 250 is an example of a hook part. The lever body 255 is an example of a release part. The tapered part 257 is an example of an inclined part.

The tapered part 257 is provided so as to protrude from a right side surface 256 of the lever body 255. More specifically, the tapered part 257 is inclined rightward in the width direction from a second end 253 side toward a first end 251 side in a longitudinal direction of the lever body 255. The tapered part 257 functions as a luring shape that guides the operation lever 250.

The cutout 259 is a recess recessed from the right side surface 256 of the lever body 255. The cutout 259 has a dimension that allows a support end 124 (see FIG. 8A that will be described later) of the bottom part 111 to be disposed therein.

As illustrated in FIG. 5A, the operation lever 250 has a part that is disposed on a far side relative to the attachment part 225 of the guide body 210 and protrudes toward a right side relative to the attachment part 225. This creates a positional relationship that allows a user to touch the operation lever 250 when a user's finger is inserted into the second opening 214. At least part of the operation lever 250 is viewable through the second opening 214.

The operation lever 250 is provided on a far side relative to the guide surface 211 of the guide body 210 so as to be away from the sheet of paper P mounted on the mount region 112. More specifically, the operation lever 250 does not protrude toward the sheet of paper P beyond the guide surface 211. This reduces occurrence of contact between the operation lever 250 and the sheet of paper P.

When a position of the rear-side restraining member 200 is fixed to the lower position determining part 114 and the upper position determining part 115, a guide upper end 215 side and a guide lower end 216 side of the guide body 210 are fixed. This keeps a position of the guide body 210 from being shifted, for example, even in a case where a user operates the operation lever 250. More specifically, it is possible to keep a position of the sheet of paper P mounted on the mount region 112 from being shifted due to shift of the position of the guide body 210.

Paper Mount Plane 116

Figure 6:
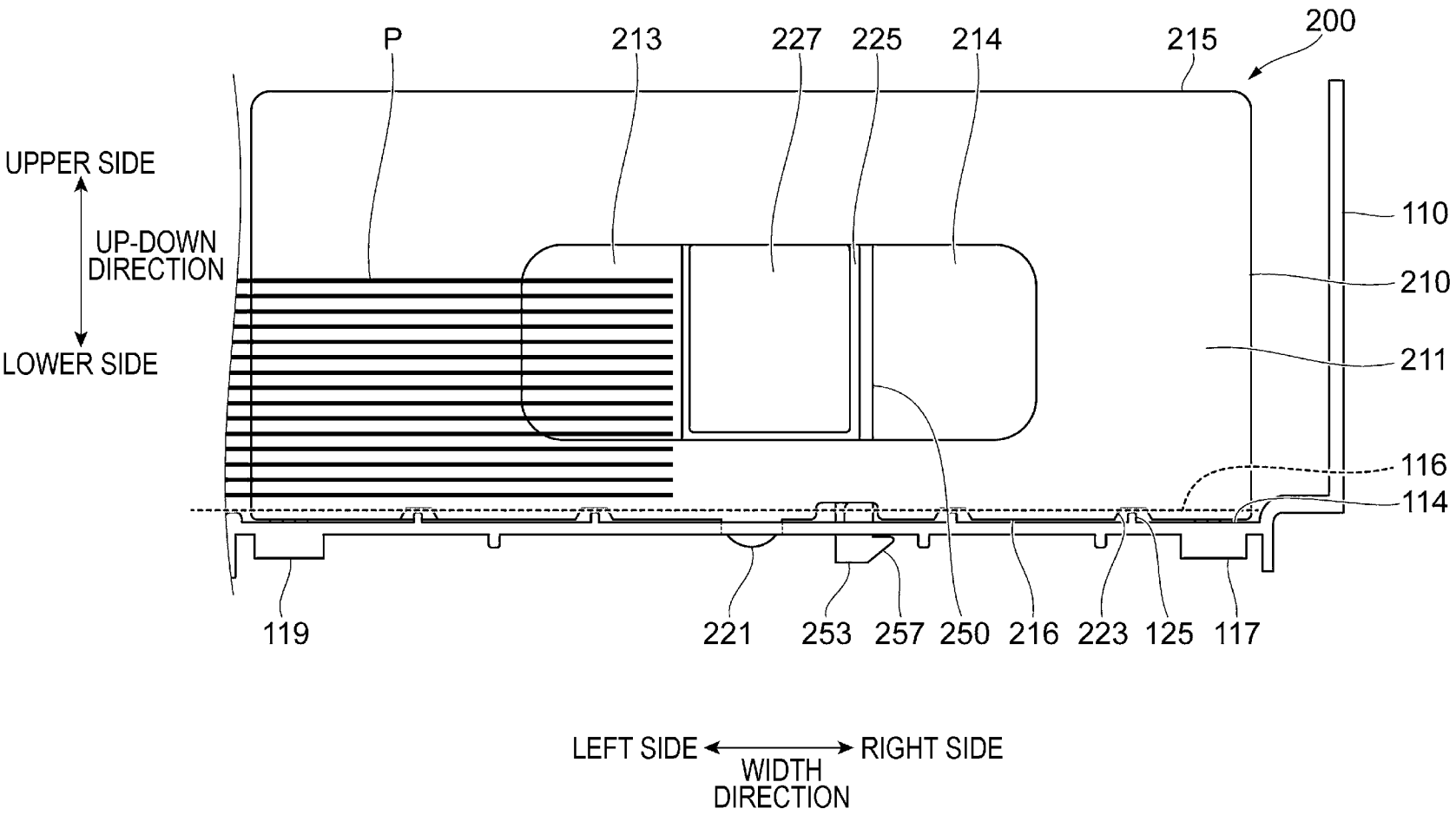
FIG. 6 is a view for explaining a paper mount plane.

FIG. 6 is a view for explaining a paper mount plane 116.

Next, the paper mount plane 116 is described with reference to FIG. 6.

As illustrated in FIG. 6, a sheet of paper P mounted on the mount region 112 (see FIG. 2) of the paper storage unit 100 is supported by top parts of the support ribs 125. A plane formed by connecting top parts of the support ribs 125 serves as the paper mount plane 116 that is a virtual plane on which the sheet of paper P is stacked. This paper mount plane 116 matches a lower-side surface of a bottommost sheet of paper P among the sheets of paper P mounted on the mount region 112.

As illustrated in FIG. 6, the paper mount plane 116 is located above the guide lower end 216 of the guide body 210. In other words, the paper mount plane 116 is located at a position different in the up-down direction from a part where the guide lower end 216 makes contact with the lower position determining part 114.

In a configuration different from the example illustrated in FIG. 6, i.e., a configuration in which the support ribs 125 are not provided and the part where the guide lower end 216 makes contact with the lower position determining part 114 matches the paper mount plane 116, a sheet of paper P sometimes slips into a region below the guide body 210. When the storage body 110 is pushed into the housing 20, force for causing a sheet of paper P moving together with the storage body 110 to shift toward the depth side is applied. Upon receipt of this force, the sheet of paper P is more likely to slip into a region below the guide lower end 216 of the guide body 210. In the present exemplary embodiment, the support ribs 125 are provided so that the paper mount plane 116 is located above the guide lower end 216 of the guide body 210. This keeps the sheet of paper P from slipping into the region below the guide lower end 216.

Position of Rear-Side Restraining Member 200 in Up-down Direction

Figure 7:
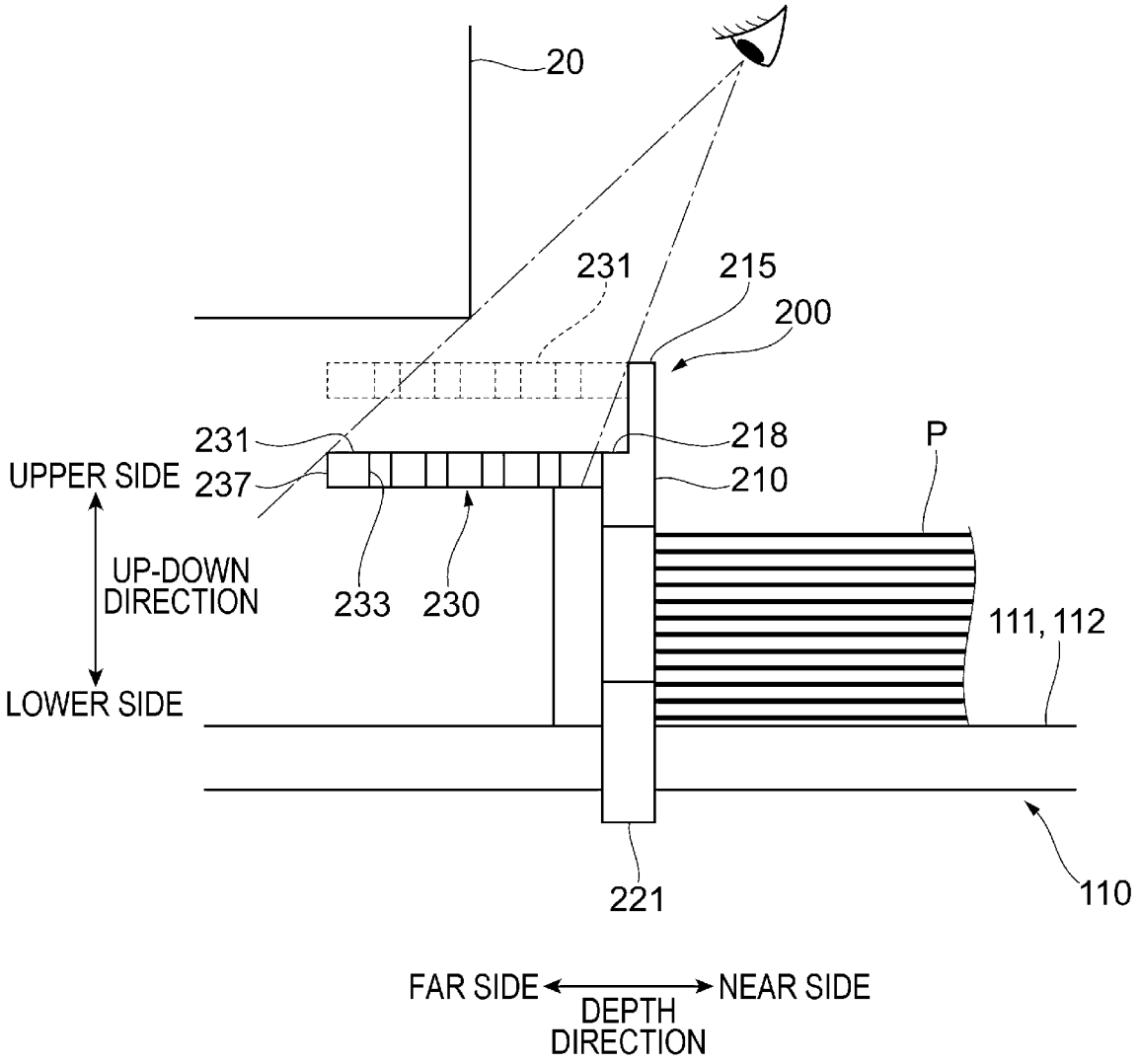
FIG. 7 is a view for explaining a position of the rear-side restraining member in an up-down direction.

FIG. 7 is a view for explaining a position of the rear-side restraining member 200 in the up-down direction. In FIG. 7, it is assumed that sheets of paper P are stacked to a highest level in the paper storage unit 100.

Next, a positional relationship of the rear-side restraining member 200 in the up-down direction is described with reference to FIG. 7.

As illustrated in FIG. 7, a height of the sheets of paper P stacked to the highest level is lower than the guide upper end 215 of the guide body 210. This keeps a sheet of paper P from going beyond the guide upper end 215, for example, when the storage body 110 is pushed into the housing 20.

The position determining surface 231 of the guide position determining part 230 is located below the guide upper end 215 of the guide body 210. This allows a user to more easily view the position determining surface 231, for example, than a case (see the broken line in FIG. 7) where the position determining surface 231 is provided at the same position as the guide upper end 215 of the guide body 210. Furthermore, for example, a user who wants to view a farthest through-hole among the position determining holes 233, the far-side end 237 of the guide position determining part 230, or the like need just draw out the storage body 110 in a smaller amount than a case (see the broken line in FIG. 7) in which the position determining surface 231 is provided at the same position as the guide upper end 215. This reduces a space for an operation of changing the position of the rear-side restraining member 200 (e.g., an operation of removing the rear-side restraining member 200). In the example illustrated in FIG. 7, the guide upper end 215 of the guide body 210 has the cutout 218. This improves viewability of the position determining surface 231 as compared with a case where the cutout 218 is not provided.

Joining Operation

Figure 8A:
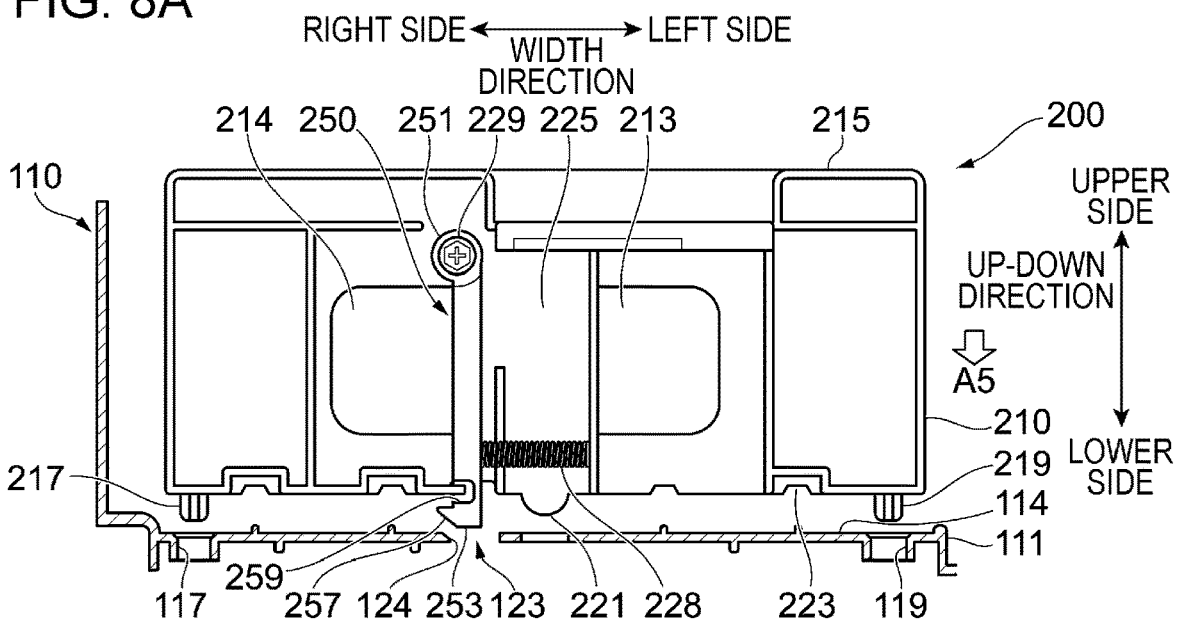
FIGS. 8A through 8C are views for explaining an operation of joining the rear-side restraining member.
Figure 8B:
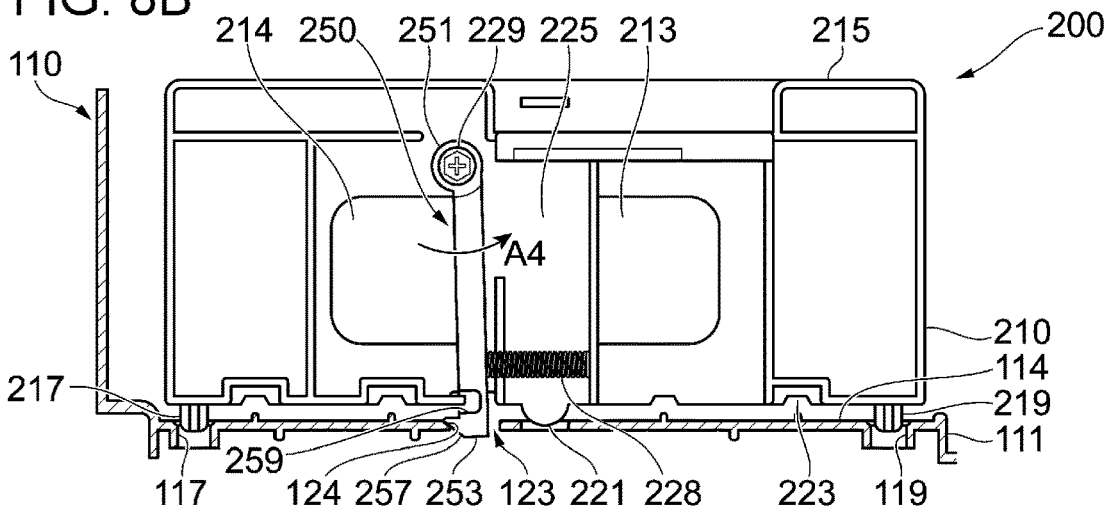
Figure 8C:
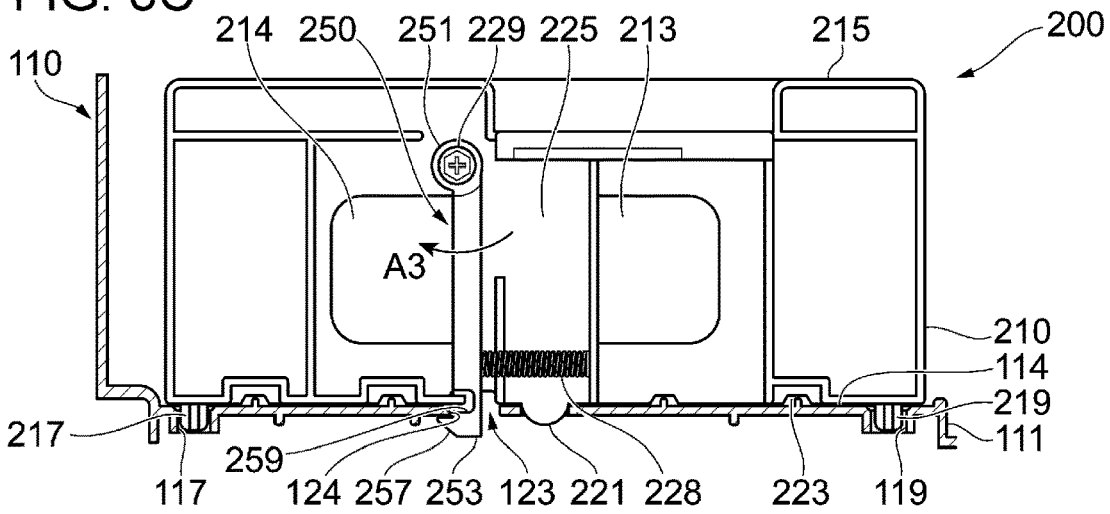

FIGS. 8A through 8C are views for explaining an operation of joining the rear-side restraining member 200. FIGS. 8A through 8C are views viewed from the far side to the near side in the depth direction.

Next, an operation of joining the rear-end restraining member 200 is described with reference to FIGS. 8A through 8C.

First, as illustrated in FIG. 8A, the rear-end restraining member 200 is held by a user and is lowered so as to fit into the lower position determining part 113 (see arrow A5 in FIG. 8A). Specifically, the first position determining protrusion 217, the second position determining protrusion 219, and the third position determining protrusion 221 are inserted into the through-holes that constitute the first position determining part 117, the second position determining part 119, and the third position determining part 121 that correspond to a size of a sheet of paper P mounted on the mount region 112. A part of the rear-end restraining member 200 held by a user is not limited in particular. For example, the rear-side restraining member 200 may be held by holding the attachment part 225 between fingers inserted into the first opening 213 and the second opening 214 of the rear-side restraining member 200. Alternatively, another part such as the guide upper end 215 of the guide body 210 may be held.

Then, as illustrated in FIG. 8B, the tapered part 257 bumps into the support end 124 when the second end 253 of the operation lever 250 enters the opening for lever 123. This causes the operation lever 250 to rotate about the support shaft 229 (see arrow A4). That is, the tapered part 257 that is a luring shape of the operation lever 250 makes contact with the bottom part 111, and thereby the second end 253 of the operation lever 250 moves leftward in the width direction.

Then, as illustrated in FIG. 8C, the rear-end restraining member 200 is further lowered. This causes the tapered part 257 of the operation lever 250 to be located below the support end 124, i.e., go beyond the support end 124. Then, the operation lever 250 rotates about the support shaft 229 (see arrow A3) due to elastic force of the coil spring 228 and thus returns to an original position. When the rear-end restraining member 200 is further lowered, the support end 124 enters the cutout 259 of the operation lever 250. In this state, since the coil spring 228 energizes the operation lever 250, rotating movement of the operation lever 250 is restricted.

In the state illustrated in FIG. 8C, even if force for causing the rear-end restraining member 200 to move upward, i.e., force for causing the operation lever 250 to move upward is applied, upward movement of the operation lever 250 is restricted because the support end 124 is present in the cutout 259 or because the tapered part 257 is present below the support end 124. Furthermore, even if force for causing the rear-end restraining member 200 to move in the width direction or the depth direction is applied, movement of the rear-end restraining member 200 is restricted because the first position determining protrusion 217, the second position determining protrusion 219, and the third position determining protrusion 221 are inserted into the first position determining part 117, the second position determining part 119, and the third position determining part 121, respectively. In this way, the rear-end restraining member 200 is fixed (locked).

As will be understood from FIG. 8 etc., the rear-end restraining member 200 has a structure such that the second end 253 of the operation lever 250 is located between the first position determining protrusion 217 and the second position determining protrusion 219 when the rear-end restraining member 200 is joined. For this reason, for example, a situation in which the rear-end restraining member 200 is joined in a state where any one of the first position determining protrusion 217 and the second position determining protrusion 219 is not completely inserted into the first position determining part 117 or the second position determining part 119 or a situation in which any one of the first position determining protrusion 217 and the second position determining protrusion 219 is detached from the first position determining part 117 or the second position determining part 119 after the rear-end restraining member 200 is joined is less likely to occur than a different structure (a structure in which the second end 253 of the operation lever 250 is not located between the first position determining protrusion 217 and the second position determining protrusion 219).

Removing Operation

Figure 9A:
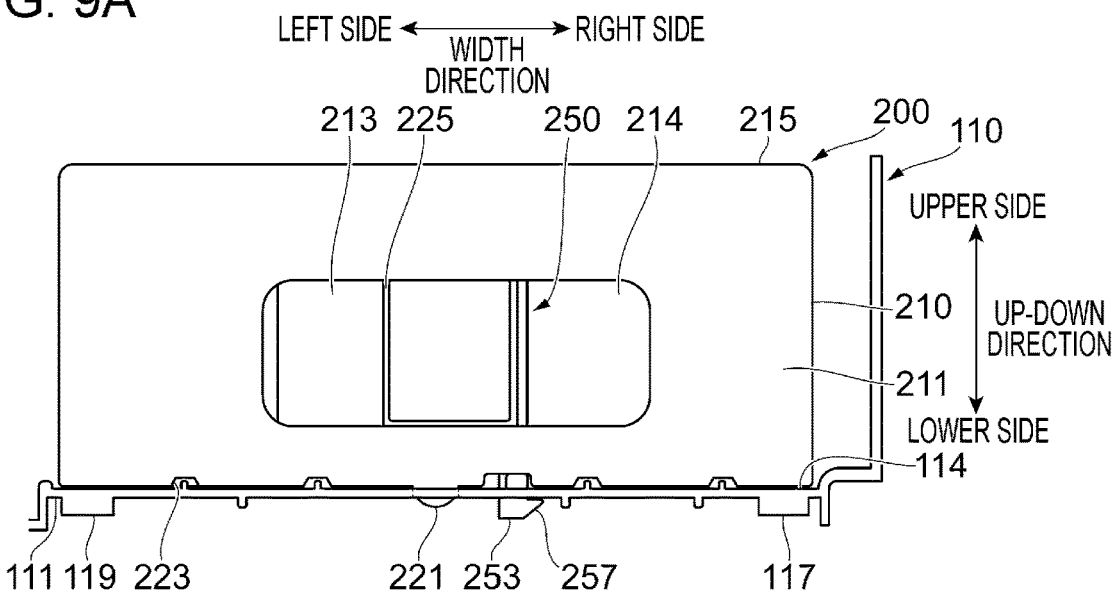
FIGS. 9A through 9C are views for explaining an operation of removing the rear-side restraining member.
Figure 9B:
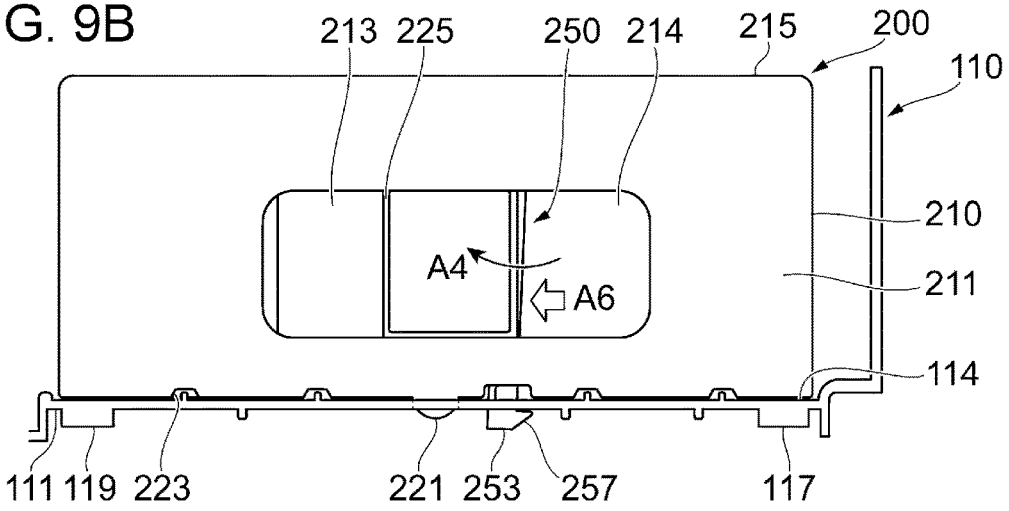
Figure 9C:
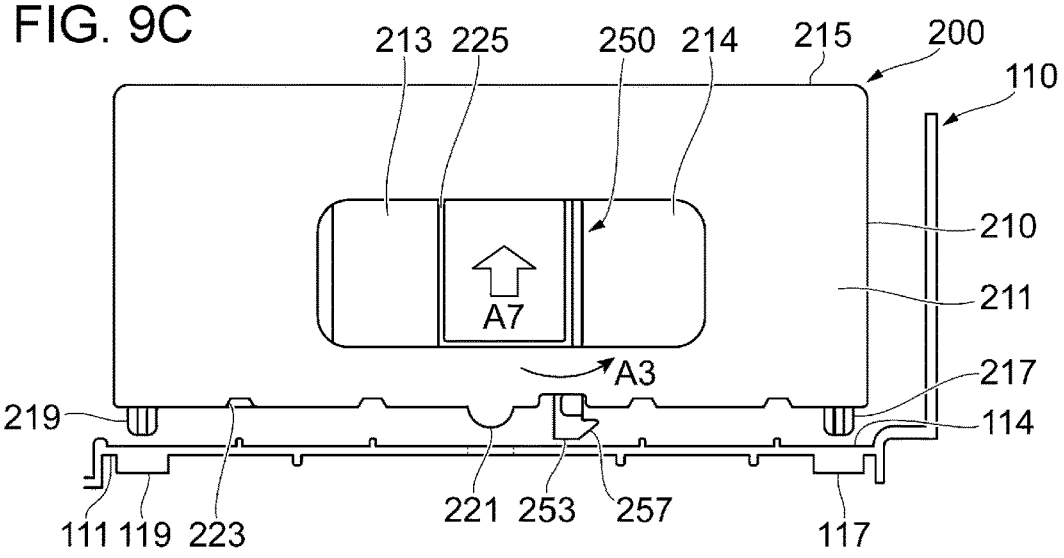

FIGS. 9A through 9C are views for explaining an operation of removing the rear-side restraining member 200. FIGS. 9A through 9C illustrate the rear-side restraining member 200 viewed from a direction opposite to FIGS. 8A through 8C, i.e., viewed from the near side to the far side in the depth direction.

Next, an operation of removing the rear-side restraining member 200 is described with reference to FIGS. 9A through 9C.

First, as illustrated in FIG. 9A, a user puts fingers (not illustrated) into the first opening 213 and the second opening 214 of the rear-end restraining member 200 that has been joined. For example, the user puts a first finger and a second finger into the first opening 213 and the second opening 214, respectively.

Then, as illustrated in FIG. 9B, the user holds the rear-side restraining member 200 by holding the attachment part 225 between the first finger and the second finger put into the first opening 213 and the second opening 214. The operation lever 250 is pushed by the second finger put into the second opening 214 (see arrow A6 in FIG. 9B). This causes the operation lever 250 to rotate about the support shaft 229 (see arrow A4). As a result, the support end 124 in the cutout 259 comes out of the cutout 259, and the tapered part 257 comes out from below the support end 124 (not illustrated in FIG. 9B). This permits upward movement of the operation lever 250.

Then, as illustrated in FIG. 9C, the rear-side restraining member 200 is hoisted up (see arrow A7 in FIG. 9C) in a state where the user has put the first finger and the second finger into the first opening 213 and the second opening 214, more specifically, in a state where the second finger is pressing the operation lever 250. In this way, the rear-side restraining member 200 is removed.

In the example illustrated in FIGS. 9A through 9C, the operation lever 250 that is an operating unit for removal is provided at a position operable from the guide surface 211 side of the rear-side restraining member 200. A position of the rear-side restraining member 200 can be changed without taking the whole rear-side restraining member 200 out from the housing 20 when the rear-side restraining member 200 located on a far side in the storage body 110 is removed.

In the example illustrated in FIGS. 9A through 9C, the operation lever 250 is operated as a result of an operation of gripping the rear-side restraining member 200. That is, the rear-side restraining member 200 is unlocked by pinching the operation lever 250 in the same direction as the operation of gripping the rear-side restraining member 200. More specifically, the fixed rear-side restraining member 200 is released by two user's operations, specifically, an operation of putting the first finger and the second finger into the first opening 213 and the second opening 214 and then gripping the rear-side restraining member 200 and an operation of hoisting the rear-side restraining member 200 up. Note that a user may hold any part of the rear-side restraining member 200 when joining the rear-side restraining member 200.

Another Exemplary Embodiment

Rear-End Restraining Member 300

Figure 10:
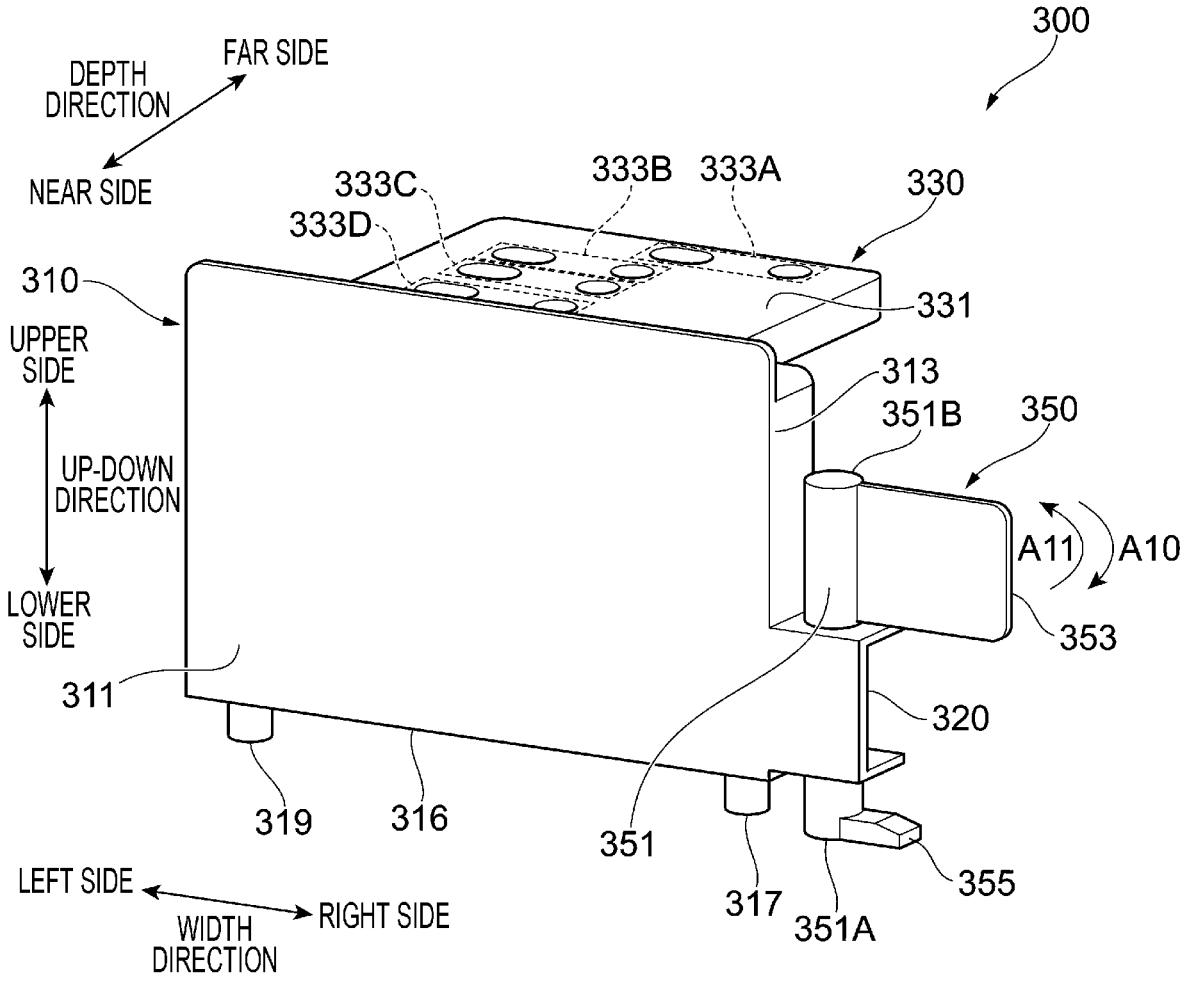
FIG. 10 is a view for explaining a rear-end restraining member in another exemplary embodiment.

FIG. 10 is a view for explaining a rear-end restraining member 300 according to another exemplary embodiment.

Figure 11A:
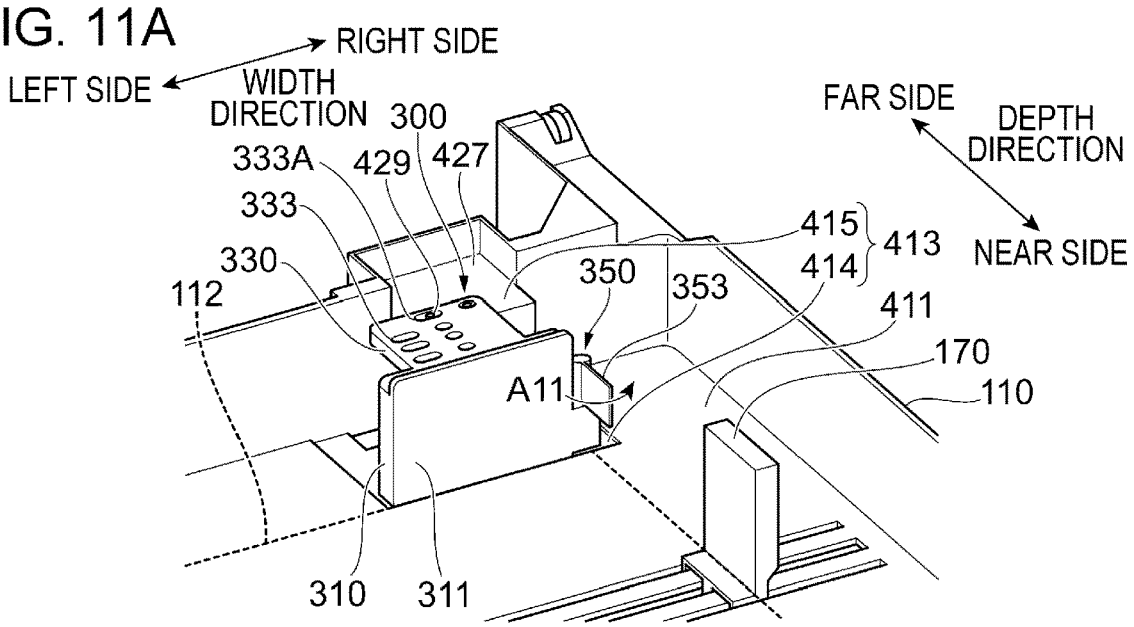
FIGS. 11A through 11C are views for explaining an operation of joining the rear-end restraining member.
Figure 11B:
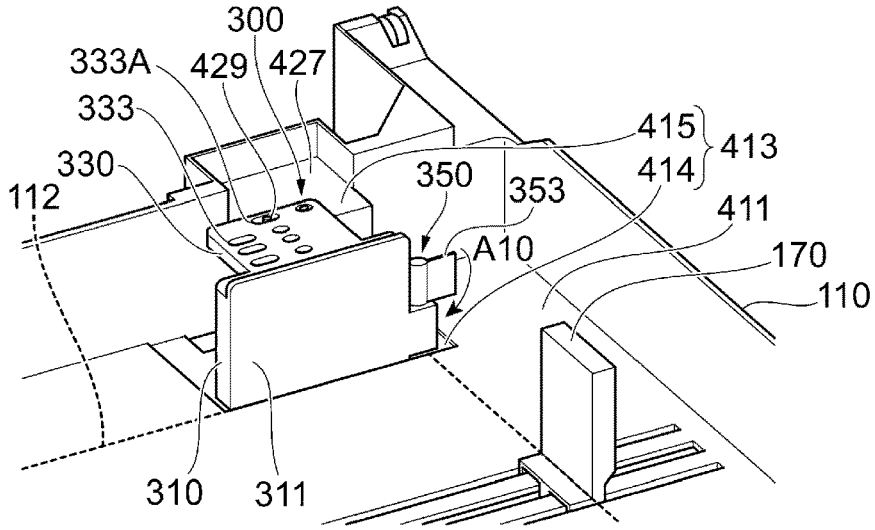
Figure 11C:
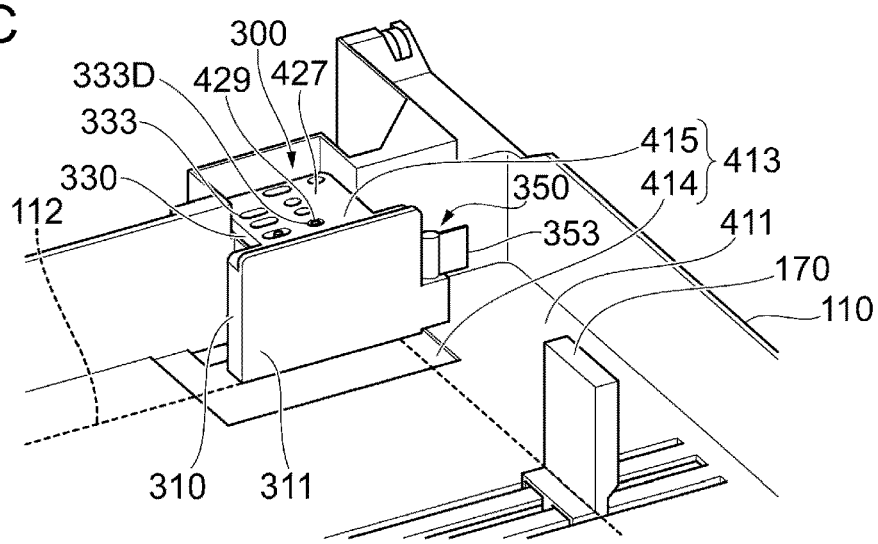

FIGS. 11A through 11C are views for explaining an operation of joining the rear-end restraining member 300.

Next, the rear-end restraining member 300 according to the other exemplary embodiment is described with reference to FIGS. 10 and 11A through 11C. In the following description, elements that are identical to those in the above exemplary embodiment are given identical reference signs, and repeated description thereof is sometimes omitted.

Although a case where the rear-end restraining member 200 has the operation lever 250 has been described above, it is only necessary that an operation unit for unlocking be provided at a position operable from a guide surface 211 side that guides a sheet of paper P.

For example, it is also possible to employ the configuration of the rear-end restraining member 300 illustrated in FIG. 10. The rear-end restraining member 300 has a guide body 310 that is a plate member, a guide position determining part 330 that is a plate member provided so as to be bent from the guide body 310, and a fixing member 350 operated by a user.

The guide body 310 has a guide surface 311 that faces the near side in the depth direction and guides a sheet of paper P, a cutout 313 provided in the guide surface 311, and a guide lower end 316 that is a lower end part of the guide body 310. The guide body 310 has a first position determining protrusion 317 and a second position determining protrusion 319 that are protrusions protruding downward from the guide lower end 316. Furthermore, the guide body 310 has a support part 320 that is provided on a right side of the guide surface 311 and rotatably supports the fixing member 350.

The guide position determining part 330 has a position determining surface 331 orthogonal to the guide surface 311 and position determining holes 333 that are through-holes formed in the position determining surface 331. In the rear-end restraining member 200, a single through-hole is provided for each size of a sheet of paper P as the position determining hole 233 (see FIG. 5A). Meanwhile, in the rear-end restraining member 300, plural, specifically two through-holes are provided for each size of a sheet of paper P (see first through fourth position determining holes 333A through 333D in FIG. 10). More specifically, one of the two through-holes is a substantially circular through-hole, and the other one of the two through-holes is an elliptical through-hole whose longitudinal direction matches the width direction. The first through fourth position determining holes 333A through 333D are located at different positions in the depth direction and the width direction in accordance with sizes of sheets of paper. Specifically, the farthest first position determining holes 333A are provided on a right side in the width direction relative to the second through fourth position determining hole 333B through 333D.

The fixing member 350 has a rotary shaft 351, a claw member 355 provided at one end 351A of the rotary shaft 351, a plate-shaped operation unit 353 provided at the other end 351B of the rotary shaft 351, a torsion spring 360 (see FIG. 12A that will be described later) wound around an outer circumference of the rotary shaft 351, and a support member 359 (see FIG. 12A) that is provided on the rotary shaft 351 and supports an end of the torsion spring 360.

The fixing member 350 rotates about the rotary shaft 351 supported by the support part 320 (see arrows A10 and A11 in FIG. 10). By changing a rotary angle of the fixing member 350, a state where the rear-end restraining member 300 has been fixed to the paper storage unit 100 and a state where the rear-end restraining member 300 has been released from the paper storage unit 100 are switched. More specifically, the fixing member 350 illustrated in FIGS. 10, 11B, and 11C is positioned at an angle at which the rear-end restraining member 300 has been fixed to the paper storage unit 100, and the fixing member 350 illustrated in FIG. 11A is positioned at an angle at which the rear-end restraining member 300 has been released from the paper storage unit 100. By rotating the fixing member 350 illustrated in FIG. 11B in a direction indicated by arrow A10 in FIG. 11B, the rear-end restraining member 300 is released from the paper storage unit 100 as illustrated in FIG. 11A.

As illustrated in FIG. 10, the claw member 355 protrudes from an outer circumferential surface of the rotary shaft 351. The claw member 355 has a tapered part 357 at a front end thereof as illustrated in FIGS. 12A through 12D that will be described later. This tapered part 357 is inclined from the one end 351A side toward the other end 351B side of the rotary shaft 351 (see FIG. 10) in a direction indicated by arrow A11 in FIG. 10 in which the fixing member 350 is rotated.

Position Determining Part 413

As illustrated in FIG. 11A, a storage body 110 has, on a far side relative to a mount region 112, a position determining part 413 that determines a position of the rear-end restraining member 300. The position determining part 413 has a lower position determining part 414 provided on a bottom part 111 and an upper position determining part 415 provided so as to protrude upward from the bottom part 111.

The lower position determining part 414 has through-holes (not illustrated) into which the first position determining protrusion 317 and the second position determining protrusion 319 are inserted. Plural pairs of through-holes are provided for respective sizes of sheets of paper P as the through-holes. The lower position determining part 414 has an opening 423 (see FIG. 12A) into which the claw member 355 is inserted. The opening 423 is provided with an abutting part 426 on which the tapered part 357 of the claw member 355 abuts when the claw member 355 is inserted. The abutting part 426 has a tapered surface 426A that is inclined downward toward the near side in the depth direction.

The upper position determining part 415 has a support surface 427 that is a surface parallel with the bottom part 111 and position determining protrusions 429 provided on the support surface 427. The position determining protrusions 429 are projections that protrude upward from the support surface 427, and plural (specifically two) position determining protrusions 429 are provided side by side in the width direction. By fixing the position determining holes 333 of the rear-side restraining member 300 to the position determining protrusions 429, a position of the rear-side restraining member 300 is determined.

Rotation of Fixing Member 350

As illustrated in FIGS. 11A and 11B, in the rear-end restraining member 300 whose position has been fixed to the position determining part 413, a user's operation of rotating the fixing member 350 switches a state where the rear-end restraining member 300 has been fixed to the storage body 110 and a state where the rear-end restraining member 300 has been released from the storage body 110. The fixing member 350 is energized so as to rotate in one direction (see arrow A11 in FIG. 12A) by the torsion spring 360 (see FIG. 12A).

Then, when the user operates the operation unit 353 of the fixing member 350 so that the operation unit 353 is disposed on a near side relative to the guide surface 311 as illustrated in FIG. 11A, the rear-end restraining member 300 is released from the storage body 110. In this state, the claw member 355 of the fixing member 350 is not engaged with a bottom part 411 and is therefore allowed to move in the up-down direction inside the opening 423.

Meanwhile, as illustrated in FIG. 11B, the operation unit 353 is disposed on a far side relative to the guide surface 311 due to elasticity of the torsion spring 360 unless the user is not holding the operation unit 353 of the fixing member 350. In this state, the rear-end restraining member 300 is fixed to the paper storage unit 100. In this state, the claw member 355 of the fixing member 350 is engaged with the bottom part 411 inside the opening 423 and is therefore restrained from moving in the up-down direction.

Position of Rear-End Restraining Member 300

Next, a position where the rear-end restraining member 300 is fixed is described. The rear-end restraining member 300 illustrated in FIG. 10 is configured such that not only a position thereof in the depth direction, but also a position thereof in the width direction is changed in accordance with a size of a sheet of paper P. Specifically, in a case where a sheet of paper P having a smallest size is mounted on the mount region 112 as illustrated in FIG. 11B, the position determining protrusions 429 are inserted into the farthest first position determining holes 333A of the guide position determining part 330. Meanwhile, in a case where a sheet of paper P having a largest size is mounted on the mount region 112 as illustrated in FIG. 11C, the position determining protrusions 429 are inserted into the nearest fourth position determining holes 333D of the guide position determining part 330. As described above, the first position determining holes 333A are provided on a right side relative to the fourth position determining holes 333D in the width direction. Accordingly, the rear-end restraining member 300 illustrated in FIG. 11B is located on a near side in the depth direction and on a left side as compared with FIG. 11C.

Joining Operation

FIGS. 12A through 12D are views for explaining an operation of joining the rear-side restraining member 300.

Next, an operation of joining the rear-end restraining member 300 is described with reference to FIGS. 12A through 12D.

Figure 12A:
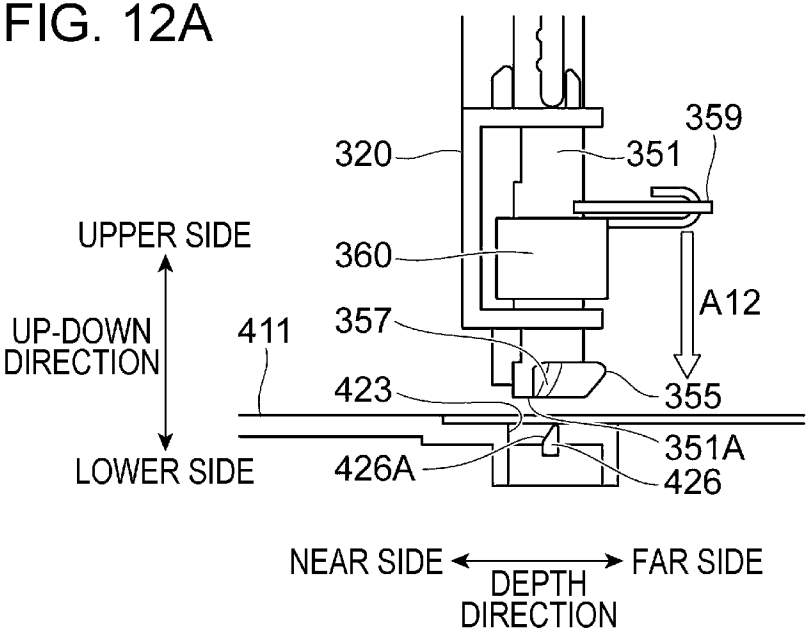
FIGS. 12A through 12D are views for explaining an operation of joining the rear-side restraining member.

First, as illustrated in FIG. 12A, the rear-end restraining member 300 is held by a user and is lowered so as to fit into the position determining part 413 (see arrow A12 in FIG. 12A). In this state, the first position determining protrusion 317 and the second position determining protrusion 319 of the guide body 310 are inserted into through-holes (not illustrated) of the lower position determining part 414.

Figure 12B:
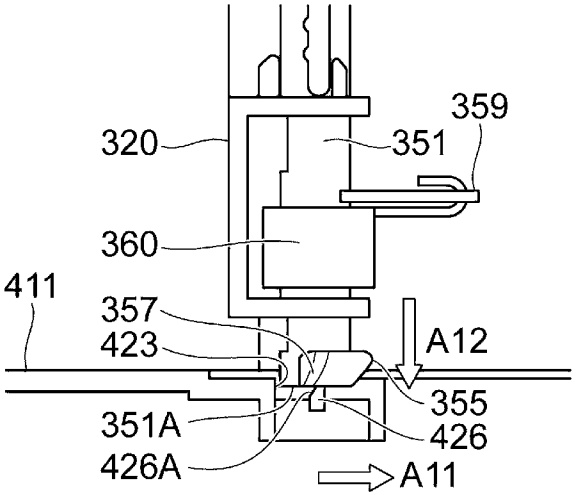

Then, as illustrated in FIG. 12B, the tapered part 357 of the claw member 355 bumps into the abutting part 426 when one end 351A of the rotary shaft 351 enters the opening 423.

Figure 12C:
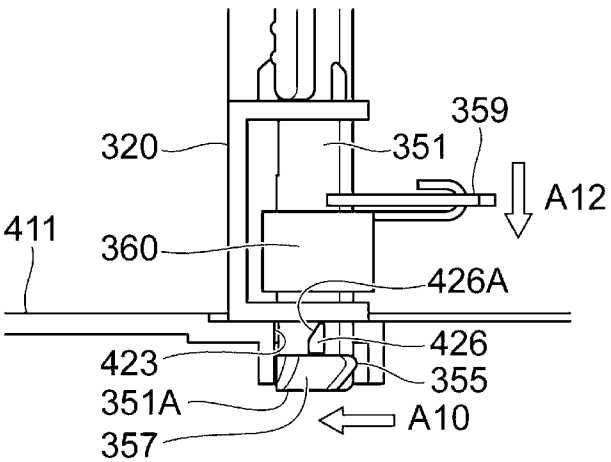

Then, as illustrated in FIG. 12C, the rear-end restraining member 300 is further lowered (see arrow A12). This causes the tapered part 357 to be pressed by the abutting part 426, thereby rotating the fixing member 350 about the rotary shaft 351 (see arrow A10 in FIG. 12C).

Figure 12D:
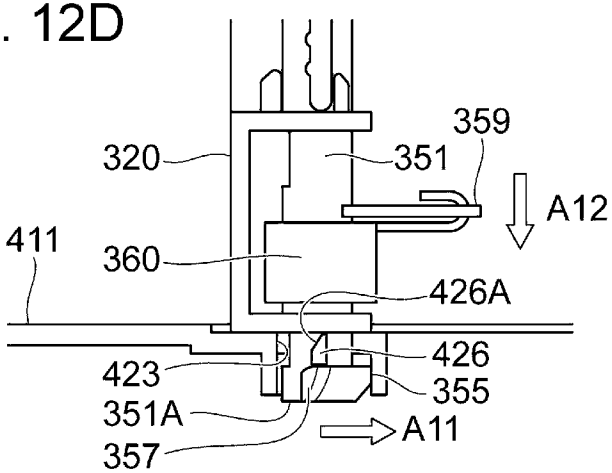

Then, as illustrated in FIG. 12D, after the tapered part 357 is located below the abutting part 426, i.e., after the tapered part 357 goes below the abutting part 426, the fixing member 350 rotates about the rotary shaft 351 due to elasticity of the torsion spring 360 (see arrow A11) and thus returns to an original position. More specifically, the claw member 355 goes into a region below the abutting part 426.

In the state illustrated in FIG. 12D, even if force for causing the rear-end restraining member 300 to move upward is given, upward movement of the rear-end restraining member 300 is restricted because the claw member 355 is present below the abutting part 426. Furthermore, even if force for causing the rear-end restraining member 300 to move in the width direction or the depth direction is given, movement of the rear-end restraining member 300 is restricted because the first position determining protrusion 317 and the second position determining protrusion 319 of the guide body 310 are present in through-holes (not illustrated) of the lower position determining part 414. In this way, the rear-end restraining member 300 is fixed (locked).

In a case where the rear-end restraining member 300 is removed (detailed description is omitted), a user operates the operation unit 353 of the fixing member 350 in the state illustrated in FIG. 12D so as to rotate the fixing member 350 (see arrow A10 in FIG. 10). This obtains the state illustrated in FIG. 12C. In this state, the rear-end restraining member 300 is moved upward. As a result, the rear-end restraining member 300 is removed (see FIG. 12A).

Modifications

Although a case where the rear-side restraining member 200 or the rear-end restraining member 300 is provided on a far side of the mount region 112 has been described above, it is only necessary that the rear-side restraining member 200 or the rear-end restraining member 300 be provided so that an attachment position thereof can be changed by a user without drawing the whole storage body 110 out from the housing 20. For example, the rear-side restraining member 200 or the rear-end restraining member 300 may be provided on a near side, a front-end side, or a rear-end side of the mount region 112. Furthermore, plural rear-side restraining members 200 or plural rear-end restraining members 300 may be provided on a near side, a front-end side, or a rear-end side of the mount region 112.

Although a case where the support ribs 125 extend continuously in the depth direction has been described above, the present disclosure is not limited to this. The support ribs 125 may extend in a different direction or each of the support ribs 125 may be constituted by plural protrusions.

Although a case where the operation lever 250 is hooked on the opening for lever 123 of the lower position determining part 114, i.e., the operation lever 250 is fixed to the bottom part 111 has been described above, the present disclosure is not limited to this. A position where the operation lever 250 is hooked may be another part such as a side surface of the storage body 110 as long as the operation lever 250 can be fixed to the storage body 110. The operation lever 250 may be fixed by hooking the operation lever 250 onto another member provided in the storage body 110.

Although various exemplary embodiments and modifications have been described, these exemplary embodiments and modifications may be combined.

The present disclosure is not limited to the above exemplary embodiments and can be modified in various ways without departing from the spirit of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an apparatus body that forms an image on a recording material;

a drawn-out unit that is provided so as to be drawable from the apparatus body in a depth direction of the apparatus body and has a mount region on which the recording material is mounted; and a guide unit that is provided on the drawn-out unit and configured to be movable in the depth direction of the apparatus body, and guides the recording material to a position where the recording material is to be mounted on the mount region, wherein the guide unit has a guide surface that guides an end of the recording material, the guide surface extends in a width direction orthogonal to the depth direction and an up-down direction orthogonal to the depth direction and the width direction and a cutout is formed in the guide surface, a hook part that is hooked onto the drawn-out unit and determines a position relative to the drawn-out unit, a release part comprising a lever body that is exposed in the cutout and releases the hook part from the drawn-out unit via a pressing force exerted onto the release part, and an energizing part comprising a spring that energizes the hook part in one direction of the width direction, wherein the release part releases the hook part from the drawn-out unit, as the pressing force is exerted onto the release part in other direction opposite to the one direction of the width direction, wherein the energizing part of the guide unit and the hook part of the guide unit are separate components.

2. The image forming apparatus according to claim 1, wherein the guide unit is provided on an upstream side relative to the mount region in a draw out direction, the draw out direction is one direction along the depth direction in which the drawn-out unit is drawn out; and the release part is provided on an upstream side relative to the guide surface in the draw out direction so as to face the cutout formed in the guide surface.

3. The image forming apparatus according to claim 2, wherein the cutout s a through-hole formed in the guide surface.

4. The image forming apparatus according to claim 3, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

5. The image forming apparatus according to claim 2, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

6. The image forming apparatus according to claim 2, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

7. The image forming apparatus according to claim 1, wherein the guide unit has a lower surface supported by the drawn-out unit and a recessed part provided in the lower surface;

the drawn-out unit has a projection that is provided on a support surface supporting the lower surface of the guide unit, is inserted into the recessed part, and supports the recording material mounted on the mount region; and the lower surface of the guide unit is located below the recording material supported by the projection in the up-down direction.

8. The image forming apparatus according to claim 7, wherein the hook part is hooked onto the drawn-out unit and restricts movement of the guide unit n the up-down direction relative to the drawn-out unit.

9. The image forming apparatus according to claim 8, wherein the hook part has an inclined part that is provided on a lower-side end of the hook part and is inclined upward toward a direction in which the hook part is energized by the energizing part.

10. The image forming apparatus according to claim 9, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

11. The image forming apparatus according to claim 8, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

12. The image forming apparatus according to claim 7, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

13. The image forming apparatus according to claim 1, wherein the guide unit has a position indicator body that is disposed on the drawn-out unit and located at a side opposite to the guide surface in the depth direction and has, on an upper surface thereof, an indicator indicative of a position where the guide unit is to be installed; and the upper surface is located below an upper end of the guide surface in the up-down direction.

14. The image forming apparatus according to claim 1, further comprising:

a sheet member attached to the guide unit; and an attachment part that is provided along the guide surface, on which the sheet member is attached, and holds the sheet member at a position away from the recording material mounted on the mount region.

15. A recording material mount device comprising:

a drawn-out unit that is provided so as to be drawable from an apparatus body in a depth direction of the apparatus body forming an image on a recording material and has a mount region on which the recording material is mounted; and a guide unit that is provided on the drawn-out unit and configured to be movable in the depth direction of the apparatus body, and guides the recording material to a position where the recording material is to be mounted on the mount region, wherein the guide unit has a guide surface that guides an end of the recording material, the guide surface extends in a width direction orthogonal to the depth direction and an up-down direction orthogonal to the depth direction and the width direction and a cutout is formed in the guide surface, a hook part that is hooked onto the drawn-out unit and determines a position relative to the drawn-out unit, a release part comprising a lever body that is exposed in the cutout and releases the hook part from the drawn-out unit via a pressing force exerted onto the release part, and an energizing part comprising a spring that energizes the hook part in one direction of the width direction, wherein the release part releases the hook part from the drawn-out unit, as the pressing force is exerted onto the release part in other direction opposite to the one direction of the width direction, wherein the energizing part of the guide unit and the hook part of the guide unit are separate components.

* * * * *